US007651407B2

(12) United States Patent
Tsai et al.

(10) Patent No.: US 7,651,407 B2
(45) Date of Patent: Jan. 26, 2010

(54) GOLF CLUB INTERCHANGING CONNECTION STRUCTURE (II)

(75) Inventors: Liang-Ho Tsai, Kaohsiung (TW); Cheng-Tao Lee, Kaohsiung (TW)

(73) Assignee: Advanced International Multitech Co., Ltd, Kaohsiung (TW)

( * ) Notice: Subject to any disclaimer, the term of this patent is extended or adjusted under 35 U.S.C. 154(b) by 0 days.

(21) Appl. No.: 12/062,022

(22) Filed: Apr. 3, 2008

(65) Prior Publication Data

US 2009/0197696 A1 Aug. 6, 2009

(30) Foreign Application Priority Data

Feb. 5, 2008 (TW) ..... 97202589 U

(51) Int. Cl.
*A63B 53/02* (2006.01)

(52) U.S. Cl. ..... 473/306; 473/307

(58) Field of Classification Search ..... 473/288, 473/296, 298–299, 306–308, 312
See application file for complete search history.

(56) References Cited

U.S. PATENT DOCUMENTS

| | | | | |
|---|---|---|---|---|
| 5,711,719 | A * | 1/1998 | Fireman | 473/251 |
| 5,951,411 | A * | 9/1999 | Wood et al. | 473/307 |
| 6,769,994 | B2 * | 8/2004 | Boone | 473/245 |
| 7,083,529 | B2 | 8/2006 | Cackett et al. | |
| 2002/0037773 | A1 * | 3/2002 | Wood et al. | 473/246 |
| 2008/0070717 | A1 * | 3/2008 | Hocknell et al. | 473/309 |
| 2009/0098946 | A1 * | 4/2009 | Hocknell et al. | 473/307 |

* cited by examiner

*Primary Examiner*—Stephen L. Blau
(74) *Attorney, Agent, or Firm*—Morris, Manning & Martin LLP; Tim Tingkang Xia

(57) ABSTRACT

A golf club interchanging connection structure for interchanging a club head and a shaft includes a tube seat, a club sleeve, a positioning mechanism, a screw, and a tapered gasket. The tube seat in the club head includes a tapered slot. The club sleeve placed in the tube seat has one end being fixed with the shaft and the other end being configured into a tapered shape and having a nut hole. The club sleeve has at least one positioning slot on its exterior. The positioning mechanism placed into the club head includes at least one positioning block corresponding to the positioning slot for positioning and fixing the club sleeve. The screw is screwed with the nut hole of the club sleeve, so as to lock the club sleeve. The tapered gasket is placed between the tapered end of the club sleeve and the tapered slot of the tube seat.

9 Claims, 7 Drawing Sheets

GOLF CLUB INTERCHANGING CONNECTION STRUCTURE (II)

This application claims the benefit of Taiwan Patent Application No. 097202589, filed on Feb. 5, 2008, which is hereby incorporated by reference for all purposes as if fully set forth herein.

BACKGROUND OF THE INVENTION

1. Field of the Invention

The present invention relates to a golf club interchanging connection structure, and more particularly to an interchanging connection structure for interchanging a club head and a shaft of a golf club.

2. Related Art

As the golf sport develops vigorously, the structure and material of the golf club have also developed accordingly. In order to cater to each golfer, and to enable the golfer to select a suitable combination of a club head and a shaft according to the specific state during striking, golf-club manufacturers exert their efforts in developing a golf club with a quick head-shaft interchanging function.

Referring to FIG. 1, it is a schematic view of a conventional golf club interchanging connection structure. In U.S. Pat. No. 7,083,529, a golf club 10 with a quick interchanging function is proposed, which includes a club head 12 and a shaft 14, and the club head 12 and the shaft 14 are interchanged quickly through an interchanging connection structure 16. The interchanging connection structure 16 includes a club sleeve 18, a tube seat 20, and a screw 22. One end of the club sleeve 18 has an opening 24, the shaft 14 is placed into the opening 24 and bonded in the club sleeve 18. The tube seat 20 is embedded into the club head 12 and bonded in the club head 12. After the club sleeve 18 is placed into the tube seat 20, the screw 22 is used to lock the club sleeve 18 to the tube seat 20, so as to quickly interchange the club head 12 and the shaft 14.

However, when the club sleeve 18 is placed into the tube seat 20, it is merely positioned through a blank of the tube seat 20, so pseudo-locking phenomenon easily occurs due to the blank variation. In addition, an outer surface of the club sleeve 18 closely contacts with an inner surface of the tube seat 20, so as to achieve the rotation-resistant effect. However, if the outer surface of the club sleeve 18 cannot closely contact with the inner surface of the tube seat 20 as expected due to the poor processing precision, the rotation-resistant force of the club head 12 and the shaft 14 of the conventional golf club 10 will be severely deteriorated.

SUMMARY OF THE INVENTION

Accordingly, in order to solve the above problems, the present invention is directed to a golf club interchanging connection structure, in which a club sleeve is positioned and fixed by using a positioning mechanism, and a tapered gasket is placed between the tapered end of the club sleeve and a tapered slot of a tube seat, which is helpful for positioning and fixing the club sleeve and the tube seat and enhancing the rotation-resistant force.

In order to achieve the objective, the present invention provides a golf club interchanging connection structure, which is applied for interchanging a club head and a shaft of a golf club. The golf club interchanging connection structure of the present invention includes a tube seat, a club sleeve, a positioning mechanism, a screw, and a tapered gasket. The tube seat is disposed in the club head and includes a tapered slot located therein. One end of the tapered slot with a smaller inner diameter is formed into a first flange in the tube seat. The club sleeve is placed into the tube seat, and has one end being connected to and fixed with the shaft and the other end having a nut hole and being configured into a tapered shape corresponding to the tapered slot in the tube seat. The club sleeve further has at least one positioning slot on an external portion thereof. The positioning mechanism is placed within the club head and includes at least one positioning block. When the club sleeve is placed into the tube seat, the positioning slot of the club sleeve must correspond to the positioning block for positioning and fixing the club sleeve. The screw is screwed with the nut hole of the club sleeve and leans against the first flange, so as to lock the shaft connected to the club sleeve. The tapered gasket is placed between the tapered end of the club sleeve and the tapered slot of the tube seat.

In order to achieve the above objective, the present invention further provides a golf club interchanging connection structure, which is applied for interchanging a club head and a shaft of a golf club. The golf club interchanging connection structure of the present invention includes a positioning mechanism, a club sleeve, a screw, and a tapered gasket. The positioning mechanism is fixed in the club head, and includes a tapered slot in an end therein. One end of the tapered slot with a smaller inner diameter is formed into a flange in the positioning mechanism. The flange has at least one positioning block on an inner side thereof. One end of the club sleeve is connected to and fixed with the shaft, and the other end has a male screw and at least one positioning slot. The club sleeve is placed into the positioning mechanism and leans against the flange, and the positioning slot must correspond to the positioning block for positioning and fixing the club sleeve. The screw is configured into a tapered shape on an external portion corresponding to the tapered slot of the positioning mechanism, and one end of the screw with a smaller outer diameter includes a nut hole that is screwed with the male screw of the club sleeve, so as to lock the shaft connected to the club sleeve. The tapered gasket is placed between the tapered screw and the tapered slot of the positioning mechanism.

With the golf club interchanging connection structure of the present invention, the club sleeve is positioned and fixed through the positioning mechanism, and the tapered gasket is placed between the tapered end of the club sleeve and the tapered slot of the tube seat, which is helpful for positioning and fixing the club sleeve and the tube seat, thereby enhancing the rotation-resistant force.

BRIEF DESCRIPTION OF THE DRAWINGS

The present invention will become more fully understood from the detailed description given herein below for illustration only, which thus is not limitative of the present invention, and wherein.

DETAILED DESCRIPTION OF THE INVENTION

In order to make the objective, structure, and function of the present invention be more comprehensible, a detailed description is given below with reference to the embodiments and accompanying drawings.

Figure 1:
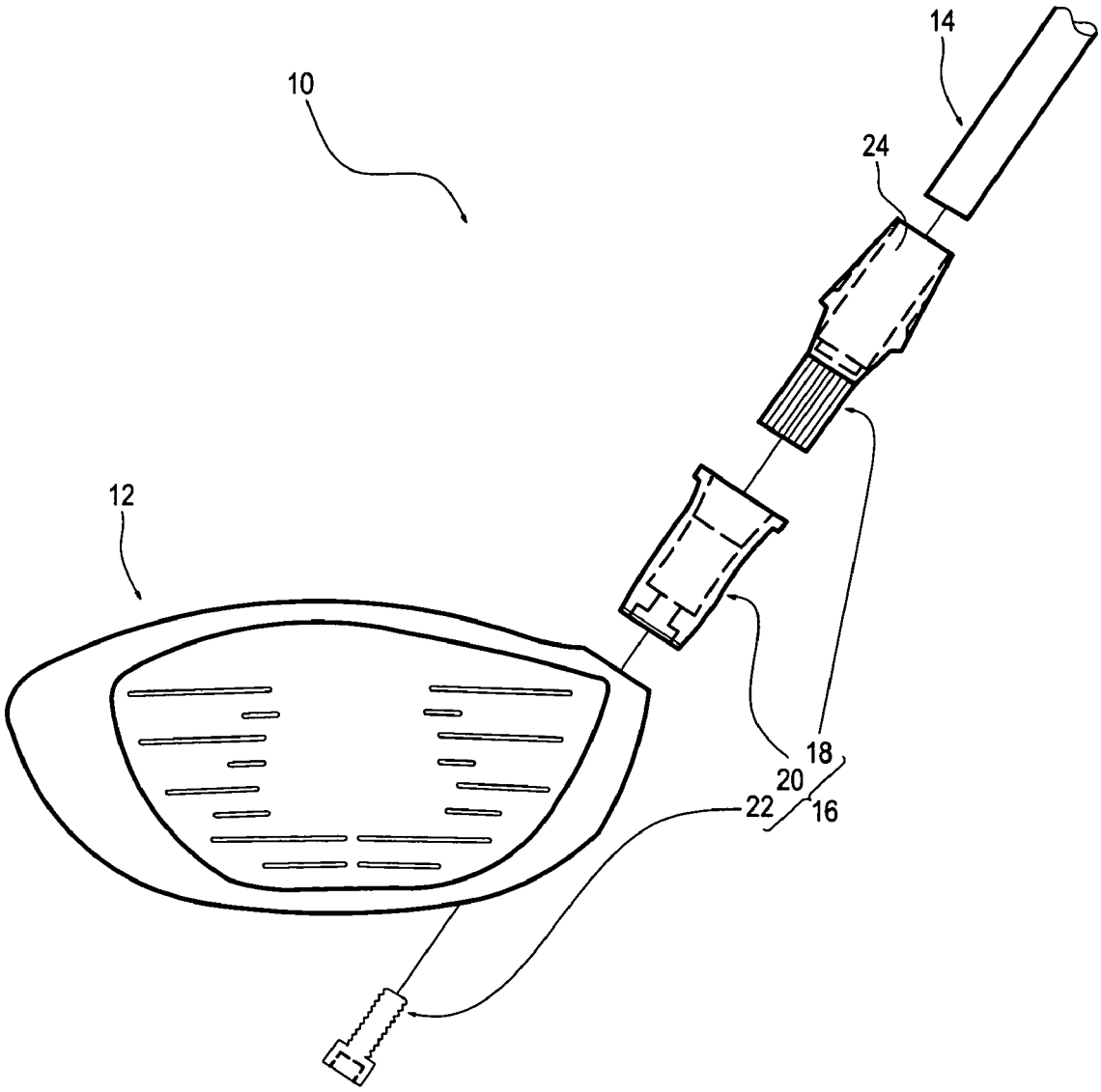
FIG. 1 (Conventional Art)
FIG. 1 is a schematic view of a conventional golf club interchanging connection structure.
Figure 2:
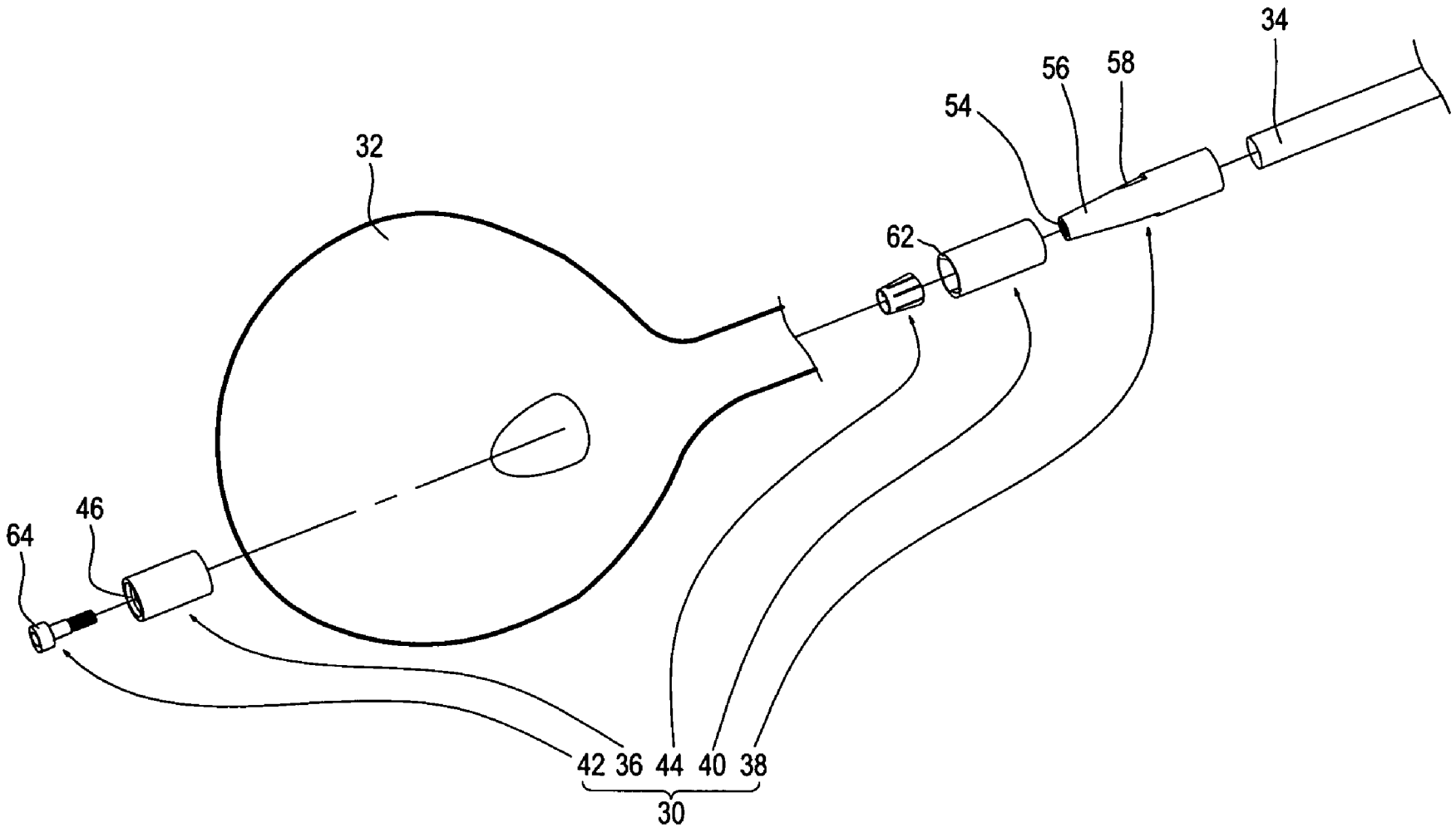
FIG. 2 is an exploded view of a golf club interchanging connection structure according to a first embodiment of the present invention.
Figure 3:
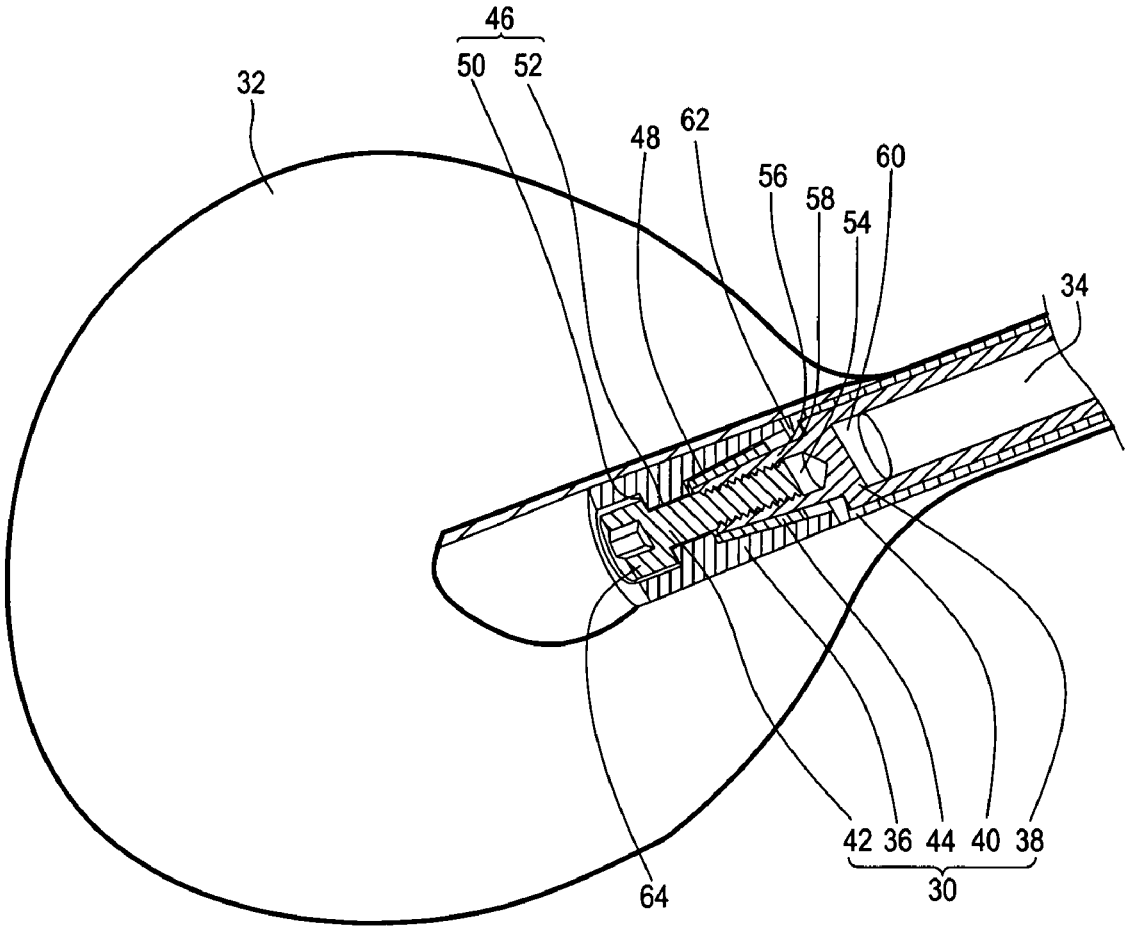
FIG. 3 is a cross-sectional view of connecting a club head with a shaft through the golf club interchanging connection structure according to the first embodiment of the present invention.

Referring to FIGS. 2 and 3, they are respectively an exploded view of a golf club interchanging connection structure according to a first embodiment of the present invention and a cross-sectional view of connecting a club head with a shaft through the golf club interchanging connection structure according to the first embodiment of the present invention. The golf club interchanging connection structure 30 in the first embodiment of the present invention is used to interchange a club head 32 and a shaft 34 of a golf club, which includes a tube seat 36, a club sleeve 38, a positioning mechanism 40, a screw 42, and a tapered gasket 44.

The tube seat 36 may be integrally formed with the club head 32 or may be jointed and disposed in the club head 32, which includes a first flange 46 and a tapered slot 48. The tapered slot 48 is located in the tube seat 36, and one end of the tapered slot 48 with a smaller inner diameter is formed into the first flange 46 in the tube seat 36, in which the first flange 46 has a leaning surface 50 and a positioning hole 52 located in the leaning surface 50.

The club sleeve 38 is place within the tube seat 36, and has one end being connected to and fixed with the shaft 34 and the other end having a nut hole 54. The end of the club sleeve 38 having the nut hole 54 is configured into a tapered shape 56 corresponding to the tapered slot 48 in the tube seat 36. The club sleeve 38 further has at least one positioning slot 58 on the external portion thereof. In addition, the club sleeve 38 has an accommodation space 60 corresponding to the shaft 34, and the shaft 34 is placed into the accommodation space 60 and bonded or welded to the club sleeve 38.

The positioning mechanism 40 is made of, for example, iron, stainless steel, pure titanium, titanium alloy, aluminum, or aluminum alloy, and it is placed into the club head 32 and fixed therein by means of bonding or welding, which includes at least one positioning block 62 corresponding to the positioning slot 58 on the external portion of the club sleeve 38. When the club sleeve 38 is placed into the tube seat 36, the positioning slot 58 of the club sleeve 38 must correspond to the positioning block 62 for positioning and fixing the club sleeve 38. The positioning mechanism 40 is tube-shaped, and the positioning block 62 is a cubic protrusion located on an inner side of one end of the tube-shaped positioning mechanism 40.

The screw 42 has a screw head 64, and it is positioned through the positioning hole 52 and screwed with the nut hole 54 of the club sleeve 38. The screw head 64 leans against the leaning surface 50, such that the screw 42 leans against the first flange 46 to lock the shaft 34 connected to the club sleeve 38.

The tapered gasket 44 is made of, for example, iron, stainless steel, pure titanium, titanium alloy, aluminum, or aluminum alloy, and it is placed between the end of the club sleeve 38 being configured into the tapered shape 56 and the tapered slot 48 of the tube seat 36. Once the screw 42 is tightly screwed, the tapered gasket 44 provides a rotation-resistant force for the shaft 34 and the club head 32.

Figure 4:
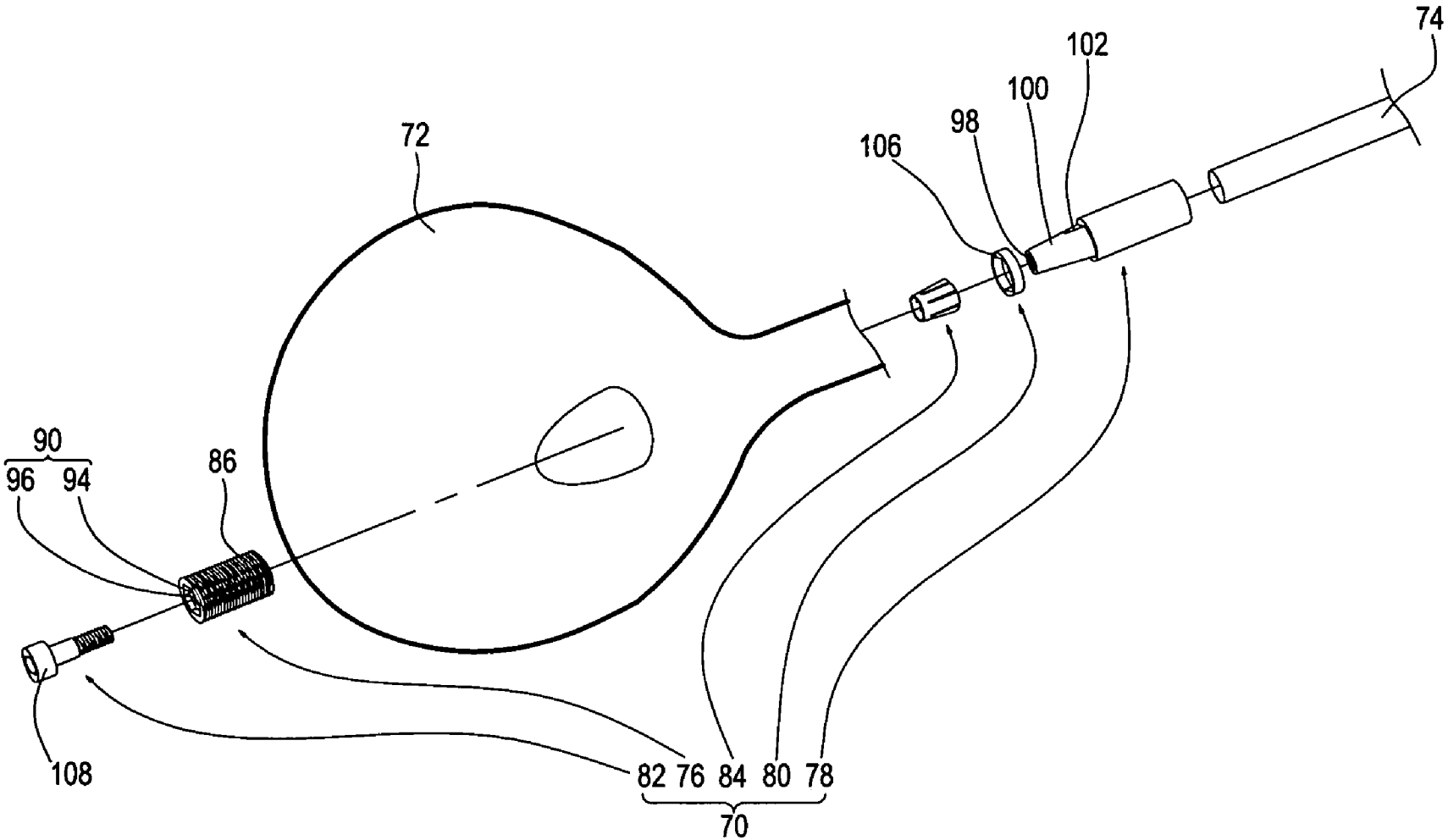
FIG. 4 is an exploded view of a golf club interchanging connection structure according to a second embodiment of the present invention.
Figure 5:
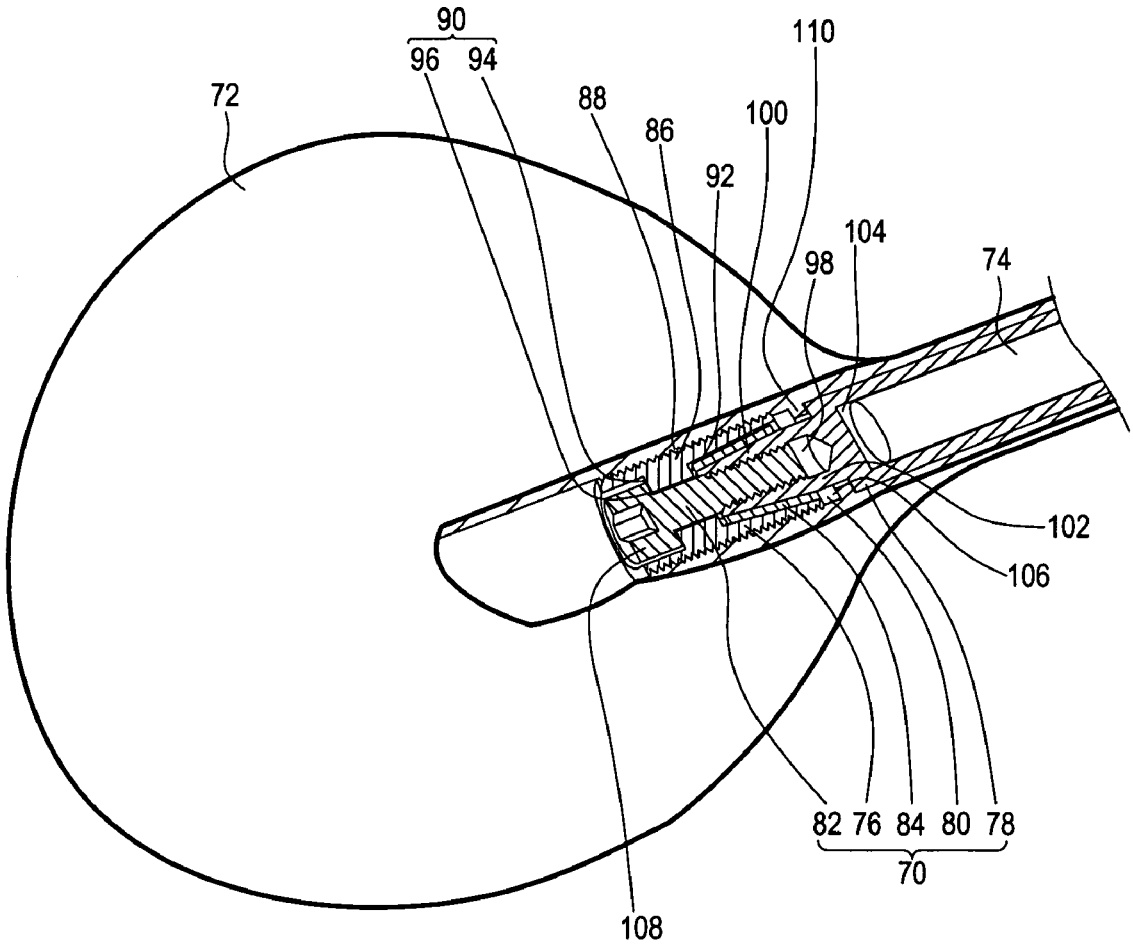
FIG. 5 is a cross-sectional view of connecting a club head with a shaft through the golf club interchanging connection structure according to the second embodiment of the present invention.

Referring to both FIGS. 4 and 5, they are respectively an exploded view of a golf club interchanging connection structure according to a second embodiment of the present invention and a cross-sectional view of connecting a club head with a shaft through the golf club interchanging connection structure according to the second embodiment of the present invention. The golf club interchanging connection structure 70 in the second embodiment of the present invention is used to interchange a club head 72 and a shaft 74 of a golf club, which includes a tube seat 76, a club sleeve 78, a positioning mechanism 80, a screw 82, and a tapered gasket 84.

The tube seat 76 has a male screw 86 on an outer surface, and it is placed into the club head 72 with the male screw 86 being screwed with a female screw 88 in the club head 72. The tube seat 76 further includes a first flange 90 and a tapered slot 92. The first flange 90 has a leaning surface 94 and a positioning hole 96 located in the leaning surface 94. The tapered slot 92 is located in the tube seat 76, and the inner diameter of one end close to the first flange 90 is smaller than that of the other end away from the first flange 90.

The club sleeve 78 is placed within the tube seat 76, and has one end being connected to and fixed with the shaft 74 and the other end having a nut hole 98. The end of the club sleeve 78 having the nut hole 98 is configured into a tapered shape 100 corresponding to the tapered slot 92 in the tube seat 76. The club sleeve 78 further has at least one positioning slot 102 on the external portion thereof. In addition, the club sleeve 78 has an accommodation space 104 corresponding to the shaft 74, and the shaft 74 is placed into the accommodation space 104 and is bonded or welded to the club sleeve 78.

The positioning mechanism 80 is made of, for example, iron, stainless steel, pure titanium, titanium alloy, aluminum, or aluminum alloy, and it is placed within the club head 72 and includes at least one positioning block 106 corresponding to the positioning slot 102 on the external portion of the club sleeve 78. When the club sleeve 78 is placed into the tube seat 76, the positioning slot 102 of the club sleeve 78 must correspond to the positioning block 106 for positioning and fixing the club sleeve 78. The positioning mechanism 80 is annular-shaped, and the positioning block 106 is a cubic protrusion located on an inner side of the annular-shaped positioning mechanism 80.

The screw 82 has a screw head 108, and it is positioned through the positioning hole 96, and screwed with the nut hole 98 of the club sleeve 78. The screw head 108 leans against the leaning surface 94, so as to lock the shaft 74 connected to the club sleeve 78.

The tapered gasket 84 is made of, for example, iron, stainless steel, pure titanium, titanium alloy, aluminum, or aluminum alloy, and it is placed between one end of the club sleeve 78 being configured into the tapered shape 100 and the tapered slot 92 of the tube seat 76. Once the screw 82 is tightly screwed, the tapered gasket 84 provides a rotation-resistant force for the shaft 74 and the club head 72.

It should be noted that, the annular-shaped positioning mechanism 80 and the tapered gasket 84 are sequentially placed into the club head 72. The positioning mechanism 80 leans against a second flange 110 in the club head 72. Then, the tube seat 76 is placed into the club head 72, and the male screw 86 is screwed with the female screw 88 in the club head 72, thereby limiting the positioning mechanism 80 and the tapered gasket 84 into the club head 72. In addition, in other embodiments, when the positioning mechanism is tube-shaped as in first embodiment, and it is bonded or welded in the club head, the tapered gasket is placed into the club head and leans against the positioning mechanism. Then, the tube seat is placed into the club head with the male screw being screwed with the female screw in the club head, thereby limiting the tapered gasket into the club head.

Figure 6:
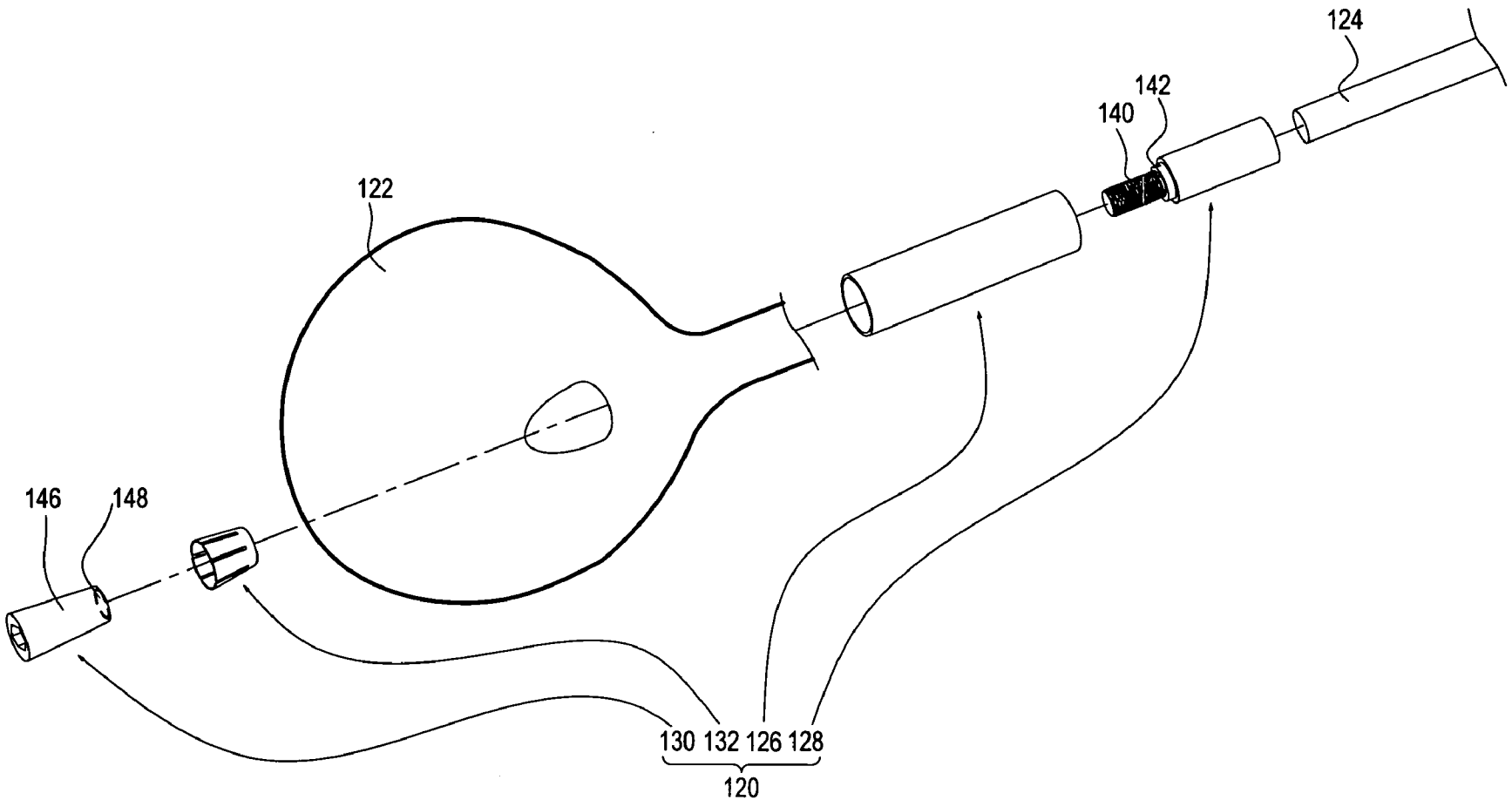
FIG. 6 is an exploded view of a golf club interchanging connection structure according to a third embodiment of the present invention.
Figure 7:
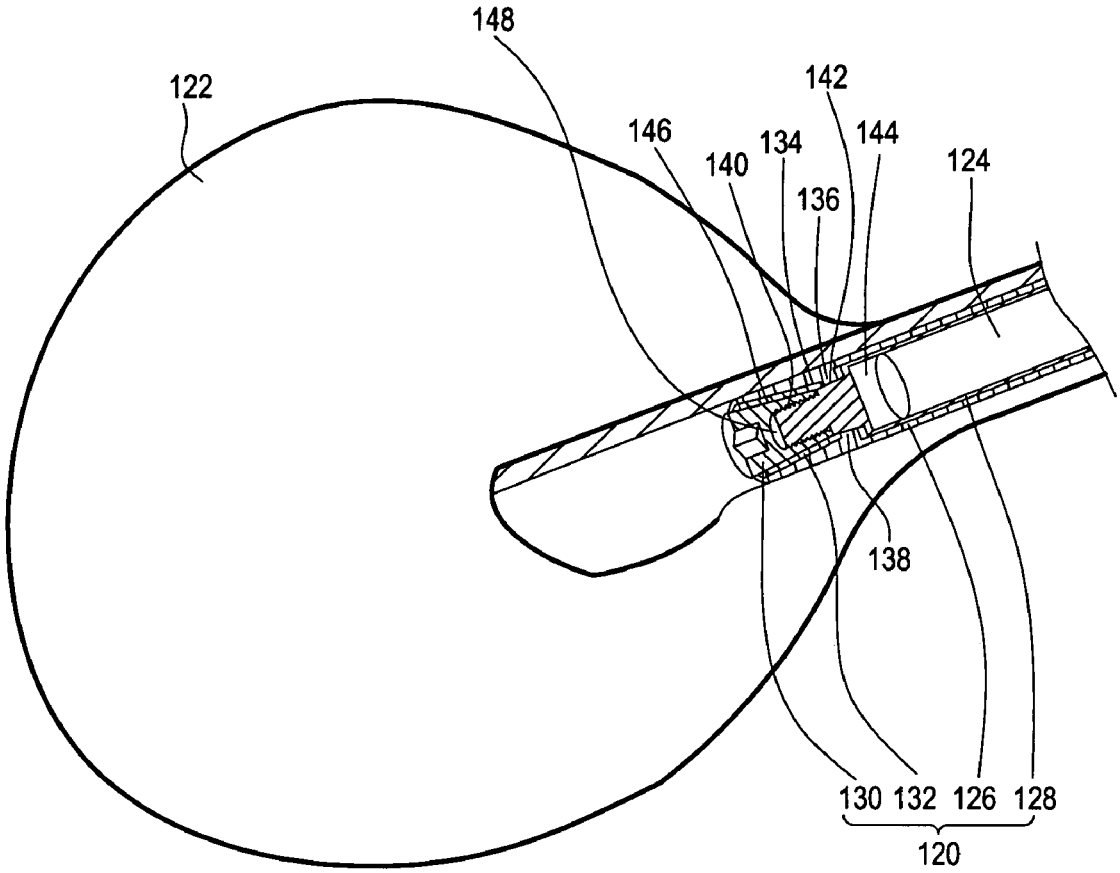
FIG. 7 is a cross-sectional view of connecting a club head with a shaft through the golf club interchanging connection structure according to the third embodiment of the present invention.

Referring to FIGS. 6 and 7, they are respectively an exploded view of a golf club interchanging connection structure according to a third embodiment of the present invention and a cross-sectional view of connecting a club head with a shaft through the golf club interchanging connection structure according to the third embodiment of the present invention. The golf club interchanging connection structure 120 in the third embodiment of the present invention is used to interchange a club head 122 and a shaft 124 of a golf club, which includes a positioning mechanism 126, a club sleeve 128, a screw 130, and a tapered gasket 132.

The positioning mechanism 126 is made of, for example, iron, stainless steel, pure titanium, titanium alloy, aluminum, or aluminum alloy, and it is fixed in the club head 122 by bonding or welding. One end in the positioning mechanism 126 includes a tapered slot 134, and one end of the tapered slot 134 with a smaller inner diameter is formed into a flange 136 in the positioning mechanism 126. The flange 136 has at least one positioning block 138 on an inner side thereof, in which the positioning block 138 is a cubic protrusion.

One end of the club sleeve 128 is connected to and fixed with the shaft 124, and the other end has a male screw 140 and at least one positioning slot 142. When the club sleeve 128 is placed into the positioning mechanism 126 and leans against the flange 136, the positioning slot 142 must correspond to the positioning block 138 for positioning and fixing the club sleeve 128. In addition, the club sleeve 128 has an accommodation space 144 corresponding to the shaft 124, and the shaft 124 is placed in the accommodation space 144 and is bonded or welded to the club sleeve 128.

The external portion of the screw 130 is configured into a tapered shape 146 corresponding to the tapered slot 134 of the positioning mechanism 126, and one end of the screw 130 with a smaller outer diameter includes a nut hole 148. The nut hole 148 of the screw 130 is screwed with the male screw 140 of the club sleeve 128, so as to lock the shaft 124 connected to the club sleeve 128.

The tapered gasket 132 is made of, for example, iron, stainless steel, pure titanium, titanium alloy, aluminum, or aluminum alloy, and it is placed between the screw 130 configured into the tapered shape 146 and the tapered slot 134 of the positioning mechanism 126. Once the screw 130 is firmly screwed, the tapered gasket 132 provides a rotation-resistant force for the shaft 124 and the club head 122.

As compared with the conventional art, in the golf club interchanging connection structure of the present invention, the club sleeve is positioned and fixed through the positioning mechanism, and the tapered gasket is placed between the tapered end of the club sleeve and the tapered slot of the tube seat, which is helpful for positioning and fixing the club sleeve and the tube seat, and enhancing the rotation-resistant force. Therefore, the present invention can overcome the pseudo-locking defects generated due to the blank variation in the conventional art, and can avoid the problem that the outer surface of the club sleeve must closely contact with the inner surface of the tube seat in the conventional art, as well as the problem that the rotation-resistant force of the club head and the shaft is severely deteriorated due to the poor processing precision.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A golf club interchanging connection structure, for interchanging a club head and a shaft of a golf club, comprising:

a tube seat, disposed in the club head, and comprising a tapered slot located in the tube seat, wherein one end of the tapered slot with a smaller inner diameter is formed into a first flange in the tube seat;

a club sleeve, placed within the tube seat, having one end being connected to and fixed with the shaft and an other end having a nut hole and being configured into a tapered shape corresponding to the tapered slot in the tube seat, and further having at least one positioning slot on an external portion thereof a positioning mechanism, placed within the club head, and comprising at least one positioning block, wherein when the club sleeve is placed into the tube seat, the positioning slot of the club sleeve corresponds to the positioning block for positioning and fixing the club sleeve;

a screw, being screwed with the nut hole of the club sleeve and leaning against the first flange, so as to lock the shaft connected to the club sleeve; and a tapered gasket, placed between the tapered end of the club sleeve and the tapered slot of the tube seat.

2. The golf club interchanging connection structure as claimed in claim 1, wherein the tube seat is integrally formed with the club head.

3. The golf club interchanging connection structure as claimed in claim 1, wherein the tube seat is jointed to the club head.

4. The golf club interchanging connection structure as claimed in claim 1, wherein the club sleeve has an accommodation space corresponding to the shaft, and the shaft is placed into the accommodation space and bonded to the club sleeve.

5. The golf club interchanging connection structure as claimed in claim 1, wherein the club sleeve has an accommodation space corresponding to the shaft, and the shaft is placed into the accommodation space and welded to the club sleeve.

6. The golf club interchanging connection structure as claimed in claim 1, wherein the positioning mechanism is annular-shaped, and the positioning block is a cubic protrusion located on an inner side of the annular-shaped positioning mechanism.

7. The golf club interchanging connection structure as claimed in claim 6, wherein the tube seat has a male screw on an outer surface, the annular-shaped positioning mechanism and the tapered gasket are sequentially placed into the club head, and the positioning mechanism leans against a second flange in the club head, then the tube seat is placed into the club head with the male screw being screwed with a female screw in the club head.

8. The golf club interchanging connection structure as claimed in claim 1, wherein the positioning mechanism is tube-shaped, and the positioning block is a cubic protrusion located on an inner side of one end of the tube-shaped positioning mechanism.

9. The golf club interchanging connection structure as claimed in claim 8, wherein the tube seat has a male screw on an outer surface, the tapered gasket is placed into the club head, and the tapered gasket leans against the positioning mechanism, and then the tube seat is placed into the club head with the male screw being screwed with a female screw in the club head.

* * * * *